US012575627B2

(12) United States Patent
Wang et al.

(10) Patent No.: US 12,575,627 B2
(45) Date of Patent: Mar. 17, 2026

(54) HAIR-BRAID LACE WITH A ONE-STRAND METHOD

(71) Applicants: Heejae Wang, Sandy Springs, GA (US); Hoyon Kim, Seoul (KR)

(72) Inventors: Heejae Wang, Sandy Springs, GA (US); Hoyon Kim, Seoul (KR)

( * ) Notice: Subject to any disclaimer, the term of this patent is extended or adjusted under 35 U.S.C. 154(b) by 512 days.

(21) Appl. No.: 18/307,861

(22) Filed: Apr. 27, 2023

(65) Prior Publication Data

US 2024/0358105 A1 Oct. 31, 2024

(51) Int. Cl.
*A41G 5/00* (2006.01)
*A41G 3/00* (2006.01)

(52) U.S. Cl.
CPC ..... *A41G 5/0053* (2013.01); *A41G 5/006* (2013.01); *A41G 3/0075* (2013.01)

(58) Field of Classification Search
None
See application file for complete search history.

(56) References Cited

U.S. PATENT DOCUMENTS 4,982,748 A * 1/1991 Trimarchi ..... A41G 5/0086 132/201
8,578,946 B2 * 11/2013 Ellery ..... A41G 5/002 132/201
8,844,541 B2 * 9/2014 Guliker ..... A41G 5/008 132/201
10,624,402 B2 * 4/2020 Kim ..... A41G 3/0075
11,490,672 B2 * 11/2022 Curbeon ..... A41G 5/006
11,832,669 B2 * 12/2023 Lotti ..... A41G 5/0046
2003/0226571 A1 * 12/2003 Rahman ..... A41G 3/00 132/201
2006/0237869 A1 10/2006 Moon et al.
2009/0071492 A1 * 3/2009 Oh ..... A41G 5/006 132/201
2017/0215505 A1 * 8/2017 Shin ..... A41G 5/0046
2017/0273380 A1 * 9/2017 Tao ..... A41G 3/0066
2018/0103706 A1 * 4/2018 Lee ..... A41G 5/006
2019/0075870 A1 3/2019 Han
(Continued)

FOREIGN PATENT DOCUMENTS

KR 10-0626792 B1 9/2006

OTHER PUBLICATIONS

Bohemian Box Braids on a Frontal Tutorial ( Bernice Burgos & Nique Inspired ) Can You Find the Lace?, TheHairGuru Carla, Jun. 25, 2020, Youtube, Florida, US., https://www.youtube.com/watch?v=QmXF6YNGac0.

(Continued)

*Primary Examiner* — Tatiana L Nobrega
(74) *Attorney, Agent, or Firm* — IP & T GROUP LLP

(57) ABSTRACT

A method for hair-braiding that includes making a lace closure is described. The one-stranded method includes making a lace closure with synthetic hair, parting locks of the synthetic hair from the lace closure into sections of hairs, pulling a loop of a crochet over a hook, attaching the sections of hairs to the hook, pulling the hook with the attached sections of hairs through the loop of the crochet, wrapping the sections of hairs around the crochet, tying a portion of the sections of hairs around the crochet, and applying heat to the wrapped sections of hairs to heat shrink the sections of hairs.

12 Claims, 17 Drawing Sheets

(56) References Cited

U.S. PATENT DOCUMENTS

| | | | | |
|---|---|---|---|---|
| 2020/0054086 | A1* | 2/2020 | Mayer | A41G 5/0046 |
| 2021/0030094 | A1* | 2/2021 | Han | D04C 1/06 |

OTHER PUBLICATIONS

How to Do:|Lace Frontal| Box Braids, BLAQtheStylist, May 30, 2021, Youtube, https://www.youtube.com/watch?v=tBT_CTkZ7qU.

Seantae Marie, Watch Me Transform This 4×5 Lace Closure to This!! Ft. Box Braids, iAmSeantaeMarie, Jun. 16, 2021, Youtube, Florida, U.S., https://www.youtube.com/watch?v=Wzgos5Wjzil.

* cited by examiner

HAIR-BRAID LACE WITH A ONE-STRAND METHOD

BACKGROUND

Field of Invention

The present disclosure generally relates to a lace closure, and more particularly, to a one-stranded method that uses the lace closure for synthetic hair extensions.

Description of Related Art

Hair styles have been passed down generations and changed throughout history, hair fashion showing the status of social class. With the development of synthetic hair products in the conventional technology, various products have been affordable to a wide range of individual budgets. Synthetic hair has also resulted in creative techniques and styles, especially in terms of braiding. However, some of the disadvantages with braiding is that depending on the skills of the braider, the braided hair can eventually slide out of the hair. On the other hand, overtightening the braids can cause hair breakage and hair loss. Moreover, the difficulty hair stylists have with braiding is the amount of time spent, the quality of the braid, and the styles of the braid.

When it comes to spending time on braiding, the amount of time for a typical braider to get the hair of an individual braided could be eight hours or more, depending on the styles and quantities of braided hair strands. The typical time duration renders conventional braiding a tedious and excessively time-consuming process.

In the existing technology, synthetic hair is attached to a natural human hair by range of affixing techniques, one of them being pre-made braided hairs called crochets. One of the many downsides of this technique is that people with short hair or no hair cannot install crochet onto their hair. And for those that can, using the person's hair as an anchor to secure crochet applies force that often creates permanent hair root damage and hair loss. The temptation of crochets being commonly affordable creates a risk of hair loss. Another disadvantage is that as time goes on the braided human hair will loosen due to the human hair growing from the scalp.

In order to enhance robustness and durability of the braid, hair stylists sometimes use individual strands of synthetic hair and attach to the natural hair. When braiding synthetic hair to natural hair, in some instances the braid slides off or loosens. In the opposite scenario, when the natural hair and synthetic hair strands are intertwined tightly, cutting the natural hair off can be the only feasible way to remove the synthetic hair.

SUMMARY

Various embodiments of the present disclosure provide a method for hair-braiding that includes making a lace closure with synthetic hair.

In accordance with an aspect of the present disclosure, the method include the following steps: making a lace closure with synthetic hair, parting locks of the synthetic hair from the lace closure into sections of hairs, pulling a loop of a crochet over a hook, attaching the sections of hairs to the hook, pulling the hook with the attached sections of hairs through the loop of the crochet, wrapping the sections of hairs around the crochet, tying a portion of the sections of hairs around the crochet, and applying heat to the wrapped sections of hairs to heat shrink the sections of hairs.

The lace closure may be attached to a natural hair of a person. Further, the attaching of the lace closure to the natural hair of the person may be performed by sewing. The heat shrinking of the sections of hairs may increase a grip of the crochet by the sections of hairs. The synthetic hair may be made of vinyon fibers or polyvinyl chloride fibers. Applying heat to the wrapped sections may melt the synthetic hair onto the crochet. The method may further comprise cooling the wrapped sections to create tight wraps around the crochet. The sections of hairs may be wrapped around the loop of the crochet to cover the loop and create a seamless install.

In accordance with another aspect of the present disclosure, a one-stranded method for hair-braiding, comprises: making a lace closure with synthetic hair, attaching the lace closure to a head of a person, parting locks of the synthetic hair from the lace closure into sections of hairs, pulling a loop of a crochet over a hook, attaching the sections of hairs to the hook, pulling the hook with the attached sections of hairs through the loop of the crochet, wrapping the sections of hairs around the crochet, tying a portion of the sections of hairs around the crochet, and applying heat to the wrapped sections of hairs to heat shrink the sections of hairs.

The lace closure may be attached to the person's scalp by gluing. In addition, the lace closure may be attached to a natural hair of the person. The attaching of the lace closure to the natural hair of the person may be performed by sewing.

BRIEF DESCRIPTION OF THE DRAWINGS

Various embodiments of the present disclosure will now be described more fully hereinafter with reference to the accompanying drawings; however, the embodiments may be embodied in different forms and should not be construed as limited to the embodiments set forth herein. Rather, these embodiments are provided so that this disclosure will be thorough and complete, and will fully convey the scope of the embodiments to those skilled in the art.

In the drawing figures, dimensions may be exaggerated for clarity of illustration. It will be understood that when an element is referred to as being "between" two elements, it can be the only element between the two elements, or one or more intervening elements may also be present.

Like reference numerals refer to like elements throughout.

FIG. 1 is a diagram illustrating a lace closure prior to the insertion of hair strands.

FIG. 2 is diagram of an enlarged view of one knot of the lace closure.

FIG. 3 is a diagram illustrating a bottom view of the lace closure subsequent to the insertion of hair strands.

FIG. 4 is a diagram illustrating a top view of the lace closure subsequent to the insertion of hair strands.

FIG. 5 is a diagram illustrating parting of the hair inserted in the lace closure.

FIG. 6 is a diagram illustrating an enlarged view of a section of the lace closure.

FIG. 7A is a diagram illustrating crochet hook.

FIG. 7B is a diagram illustrating a crochet device.

FIG. 8 is a diagram illustrating a step of pulling a crochet device over the crochet hook.

FIG. 9 is a diagram illustrating a step of attaching a section of hair to a crochet hook inside a crochet loophole.

FIG. 10 is a diagram illustrating a step of using the crochet hook to pull hair strands through a crochet loophole.

Figure 11:
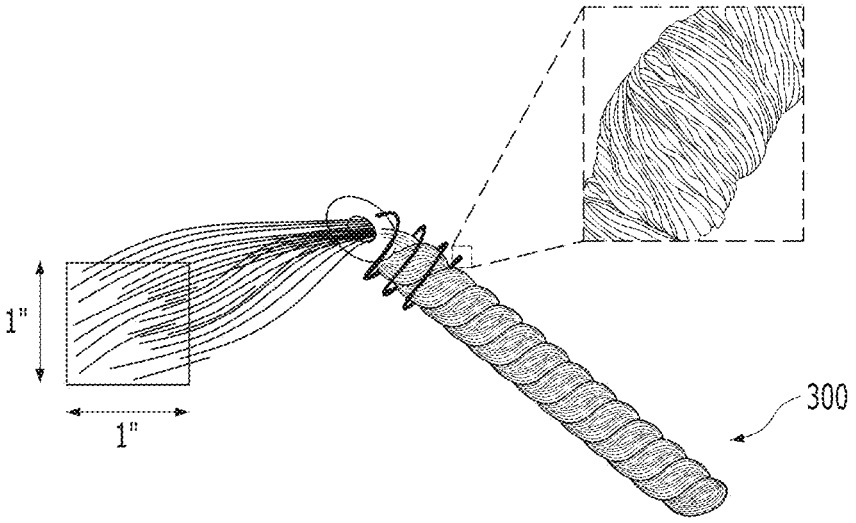

FIG. 11 is a diagram illustrating a step of wrapping a section of hair around the crochet.

Figure 12:
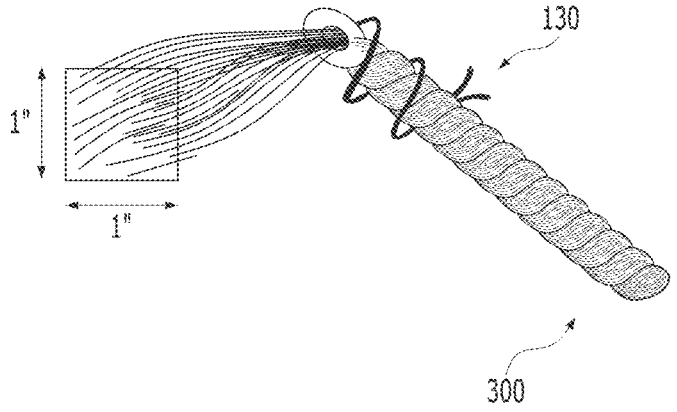

FIG. 12 is a diagram illustrating a step of preparing hair strands for tying.

Figure 13:
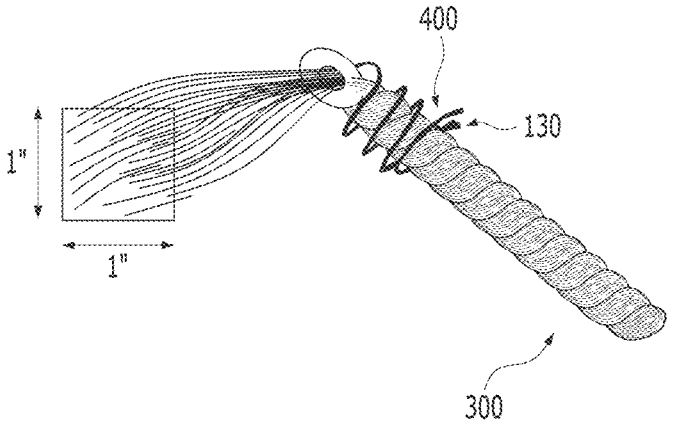

FIG. 13 is a diagram illustrating a step of tying hair strands into a knot around the crochet.

Figure 14:
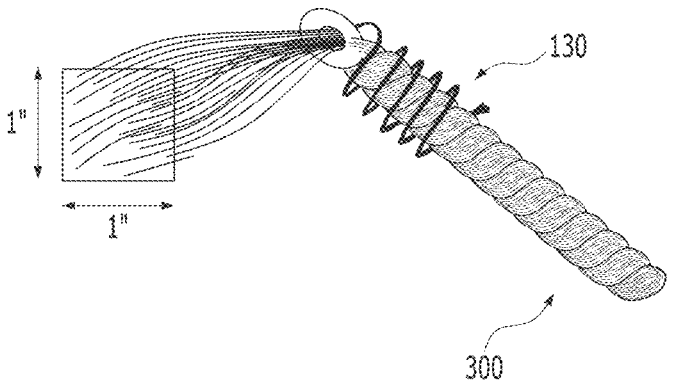

FIG. 14 is a diagram illustrating a step of completing the wrapping of the hair strands around the crochet.

Figure 15:
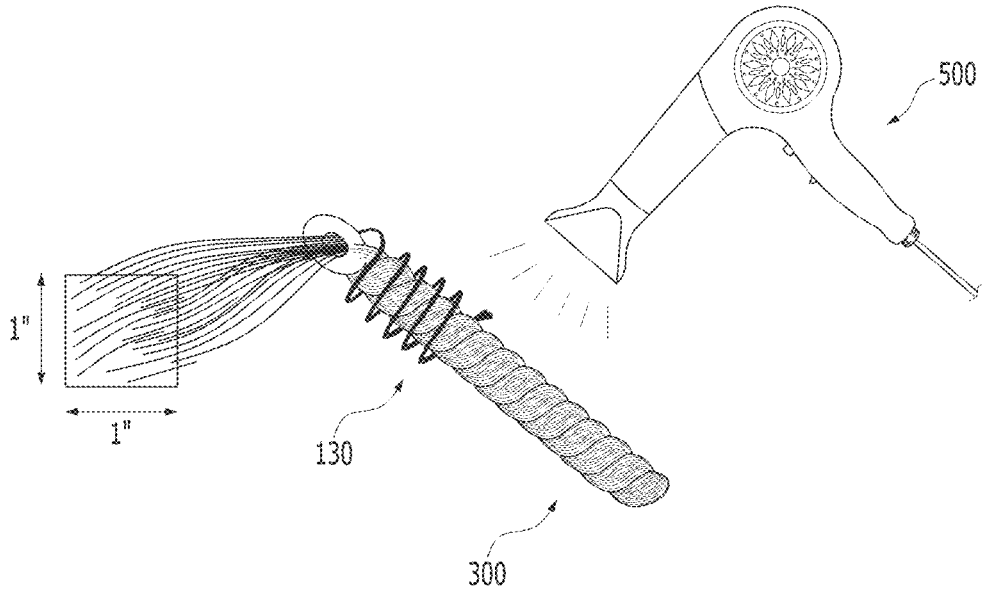

FIG. 15 is a diagram illustrating a step of applying heat to the hair strands wrapped around the crochet.

Figure 16:
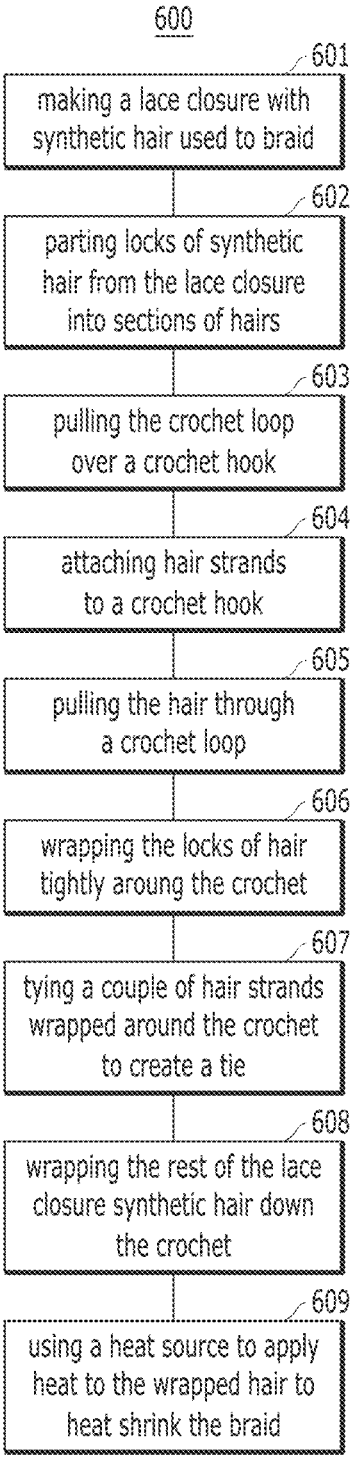

FIG. 16 is a flowchart illustrating a one-strand method of synthetic hair-braiding using a lace closure.

DETAILED DESCRIPTION

The specific structural or functional description disclosed herein is merely illustrative for the purpose of describing embodiments according to the concept of the present disclosure. The embodiments according to the concept of the present disclosure can be implemented in various forms, and cannot be construed as limited to the embodiments set forth herein.

One embodiment of the present application shows crochet braids as a technique for braiding hair that involve crocheting synthetic hair extensions to a person's natural hair with a latch hook or crochet hook. The natural hair is braided down into cornrows from front to back of the head.

One example of the present application applies synthetic hair strands with desired properties, such as hair shrinkage, and hair porosity, by determining an optimal balance of human-like-hair texture, shine, heat shrink property, and weight. Some of the synthetic fibers used may be ADM, ADKN, ADE, TOYO-M, F-GM, AR-TYPE, AFY, FARANG-B, MT, MOC, GM, FR, MT, HS-77, AFS, MT, MOC, GM.

In yet another embodiment, a lace media is laid on a person's scalp or with hair that is braided into knotless synthetic hair extensions with different styles. In another embodiment, a person's natural hair is sewed into a lace media that includes knotless synthetic hair extensions with different styles. The lace closures may be used for human hairstyling to cover a front portion of a person's head. In still another embodiment, a hairstylist installs the braiding lace on any part of the head, such as a top portion, a back portion or any of the side portions of the head.

In one embodiment, the lace media is applied on a person with hair loss, or to cover bald spots with the knotless braid style. The lace media may be affixed to the person's scalp by gluing, or any other means deemed suitable. In yet another embodiment, the lace media may be attached to the person's natural hair.

Figure 1:
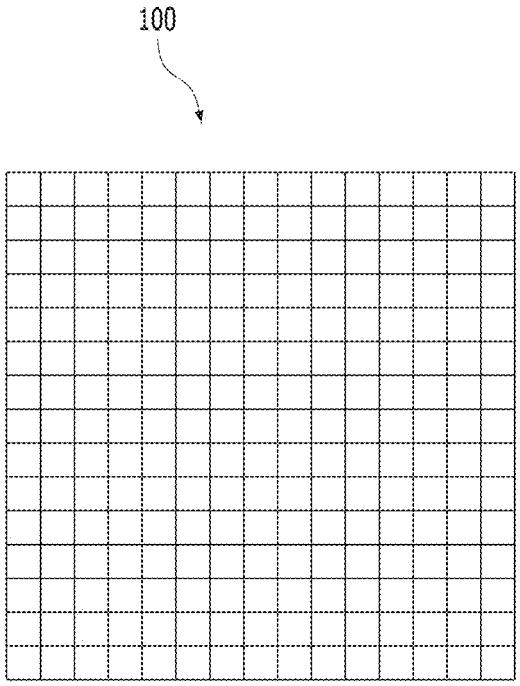

In FIG. 1, a lace closure 100 is shown with no hair strands inserted. In one embodiment, the lace closure 100 is a piece of fabric made of either a natural or a synthetic material made in any shapes with holes, but the shape of the lace closure 100 is not limited to such a shape. The lace closure 100 may be round, elliptical, or made in any other shape considered appropriate. The lace closure 100 may be transparent or opaque and, while its color is preferred to blend in with the scalp of the person, it can be made in any color deemed appropriate. The lace closure 100 may be made of a synthetic or a natural material.

Figure 2:
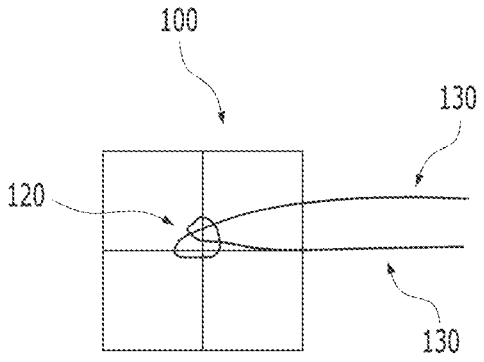

In one embodiment of the present application, the lace closure 100 includes multiple perforations arranged in a matrix, but the arrangement of the perforations is not so limited. FIG. 2 shows an enlarged view of a perforation 120 of the lace closure 100. In the embodiment shown in FIG. 2, a hair strand 130 is inserted into the perforation 120 and tied into a knot, thereby attaching the hair strand 130 to the lace closure 100.

The number of the perforations 120, i.e., the hair strands 130 in one lace closure 100 depends on the dimensions of the lace closure 100, but also on the desired hair density of the lace closure 100. The number of hair strands are not so limited for tying the knot. The hair density of the lace closure 100 may vary. The smaller the distance between the perforations 120 in the lace closure 100, the denser the dispersion of the hair strands 130. Also, the number of hair strands per typing of the knot increases the density.

Figure 3:
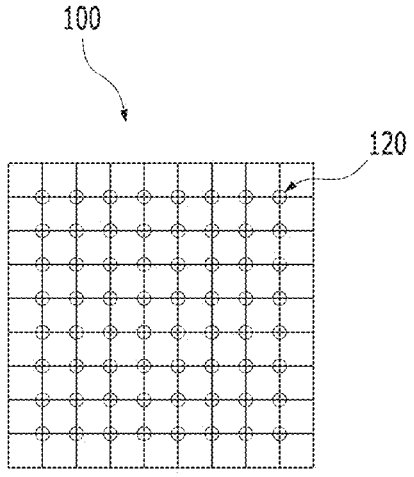
Figure 4:
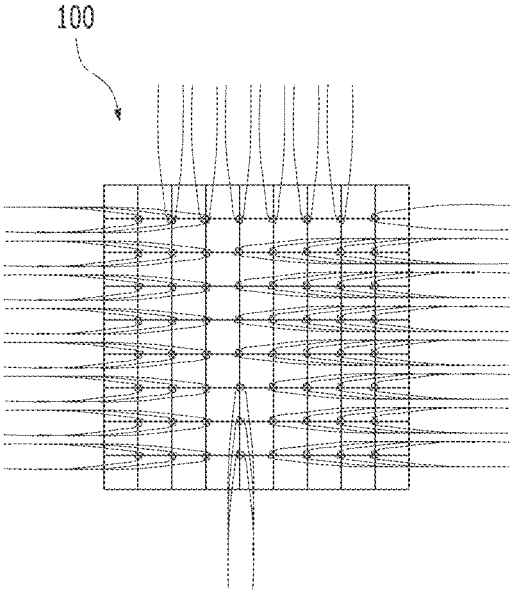
Figure 5:
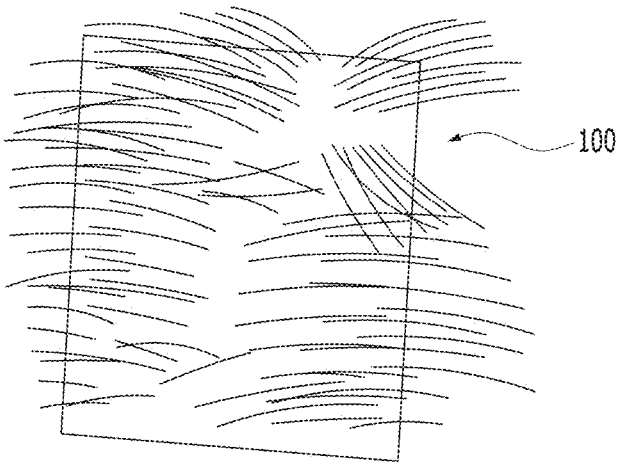

FIG. 3 is a bottom view of the lace closure 100 subsequent to the insertion of hair strands 130 in their respective perforations 120. FIG. 4 illustrates a top view of the lace closure 100 subsequent to the insertion of hair strands 130. The length of the hair strands 130 extending from the lace closure 100 can vary depending on the desired usage. In one embodiment, the hair strands 130 are parted into sections of hairs in preparation for forming hair extensions, as shown in FIG. 5.

Figure 6:
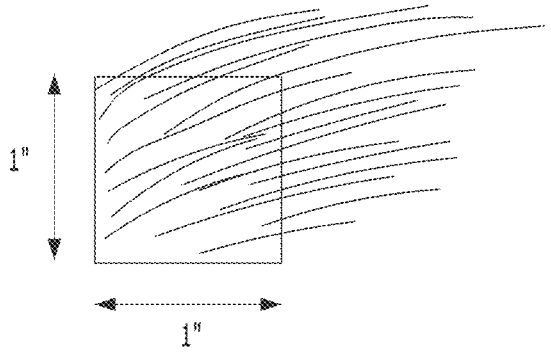

FIG. 6 shows a unit of parting the hair strands 130, for example, a 1 inch by 1 inch unit. The size of the unit of parting the hair may vary depending on the density of the hair strands 130, the strength of the material used for the hair strands 130, as well as the aesthetic preferences of the hair extension.

Figure 7A:
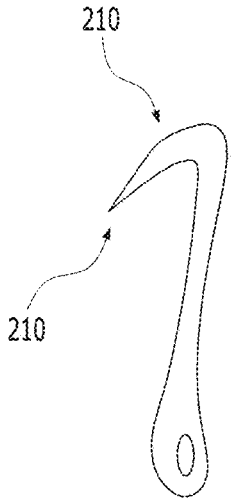
Figure 7B:
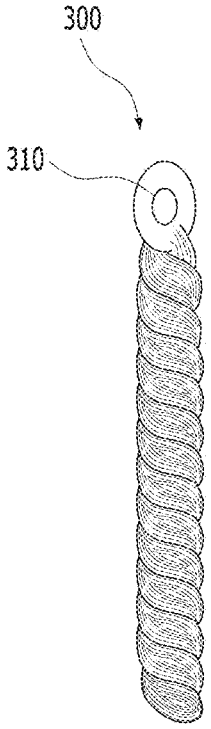

FIG. 7A shows crochet hook 200 with a pull strand portion 210 used for temporarily attaching the hair strands 130 and threading them through openings and apertures. FIG. 7B depicts a crochet device 300 with a loophole 310.

Figure 8:
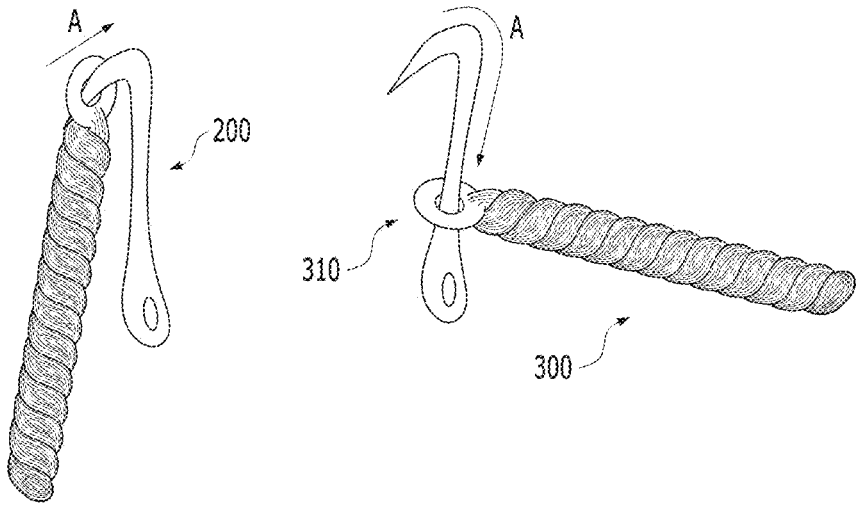
Figure 9:
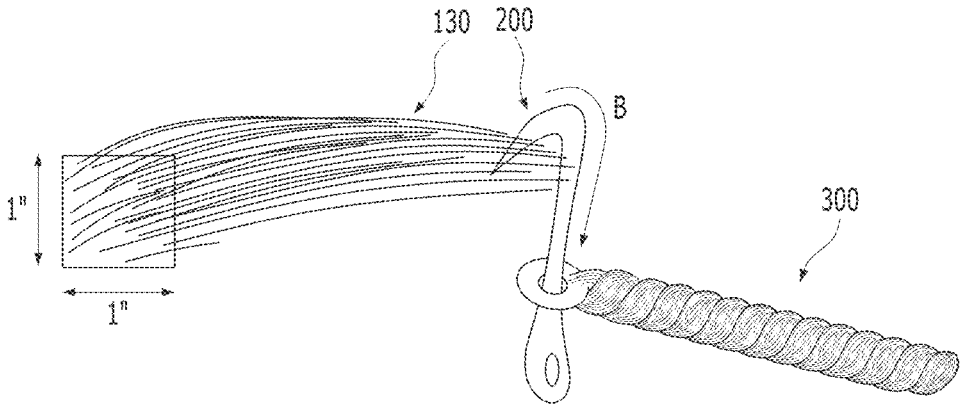

In the embodiment shown in FIG. 8, the loophole 310 from the crochet 300 is pulled over the crochet hook 200 in direction A. As shown in FIG. 9, the parting section of the lace closure 100 which can be adjusted in parting size is shown with the hair strands 130 extending therefrom. The strands 130 are connected to the crochet hook 200, and the hook 200 is then moved in direction B to be threaded through the loophole 310 of the crochet device 300.

Figure 10:
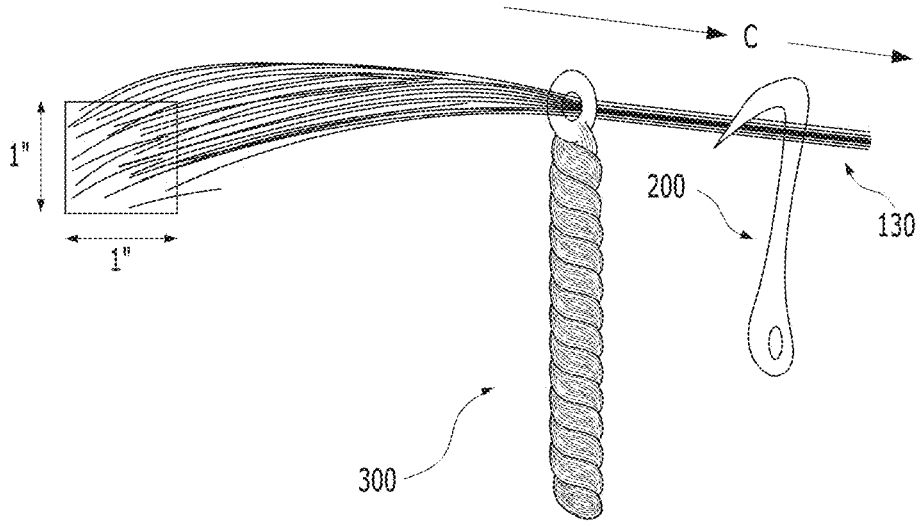

As shown in FIG. 10, the strands 130 carried by the hook 200 are then also pulled in direction C through the loophole 310 and straightened subsequently. FIG. 11 illustrates that the strands 130 are then bent and wrapped around ridges and grooves of the crochet device 300, thereby gripping the device 300 by forming a spiral of connection with the crochet device 300 on a lateral surface of the device 300.

In one embodiment, a certain distance is left between the lace closure 100 and the crochet device 300 by maintaining a portion of the strands 130 that provide the separation for a natural look of the hair extension. This distance can be controlled by the positioning of the crochet device 300 and can be preserved by wrapping the strands 130 around the device 300 only after the necessary length of the strands 130 is maintained straight.

FIG. 12 shows the strands 130 wrapped to a sufficient length, i.e., number of turns around the crochet device 300. The ends of the strands 130 are preserved unwrapped for a predetermined length in preparation for tying. The length of the unwrapped portion depends on the properties of the synthetic fiber material that the strands 130 are made of, such as, thickness, axial strength, friction coefficient, heat shrinking properties, among others.

As illustrated in FIG. 13, the preserved unwrapped portions of the strands 130 are then tied around a knot 400 for fastening to the crochet device 300. Afterwards, the remainder of the strands 130 are wrapped around the device 300, as illustrated in FIG. 14.

In one embodiment, a heat source 500 is used to apply heat onto the synthetic hair strands 130 in order to heat shrink the strands 130 and produce a tighter grip of the strands 130 onto the grooves and ridges of the crochet device 300. The amount of heat and the gripping force of the strands 130 depend on the synthetic fiber material of the strands 130.

FIG. 16 is a flowchart showing steps of a one-strand method 600 of synthetic hair-braiding using a lace closure. In step 601, a lace closure with multiple perforations is used to insert a hair strand in each of the perforations to be tied into a knot. Thereby, the hair strand is attached to the lace closure.

The number of the perforations, i.e., the hair strands in one lace closure may depend on the dimensions of the lace closure, but also on the desired hair density of the lace closure. The hair density of the lace closure may vary. The smaller the distance between the perforations in the lace closure, the denser the dispersion of the hair strands. The length of the hair strands extending from the lace closure can vary depending on the desired usage.

In step 602, the hair strands are parted into sections of hair in preparation for forming hair extensions. Dimensions of a unit of parting the hair strands may be predetermined, for example, a 1 inch by 1 inch unit. The size of the unit of parting the hair varies depending on the density of the hair strands, the strength of the material used for the hair strands, as well as the aesthetic preferences of the hair extension, among other criteria.

In step 603, the loophole from the crochet is pulled over the crochet hook. Subsequently, a crochet hook with a pull strand portion may be used for temporarily attaching the hair strands and for threading them through openings and apertures. In step 604, the strands are connected to the crochet hook, and the hook is then threaded through a loophole of a crochet device (step 605).

The strands are then bent and wrapped around ridges and grooves of the crochet device in step 606, thereby gripping the crochet device, and forming a spiral of connection with the crochet device on a lateral surface of the device. A certain distance may be kept between the lace closure and the crochet device by maintaining a portion of the strands that provide the separation for a natural look of the hair extension. This distance can be controlled by the positioning of the crochet device and can be preserved by wrapping the strands around the device only after the necessary length of the strands is maintained straight.

Further, the strands are wrapped to a sufficient length, i.e., for a predetermined number of turns around the crochet device. The ends of the strands are preserved unwrapped for a predetermined length in preparation for the tying in step 607. The length of the unwrapped portion may depend on the properties of the synthetic fiber material that the strands are made of, such as, thickness, axial strength, friction coefficient, heat shrinking properties, among others. The preserved unwrapped portions of the strands are then tied in step 607 into a knot for a permanent attachment to the crochet device. Afterwards, the remainder of the strands are wrapped around the device in step 608.

In step 609 a heat source is used to apply heat onto the synthetic hair strands in order to heat shrink the strands and produce a tighter grip of the strands onto the grooves and ridges of the crochet device. The amount of heat and the gripping force of the strands depend on the synthetic fiber material of the strands.

The hair on the lace may be made of vinyon fibers or polyvinyl chloride fibers. In one embodiment, the fiber shows its unique melting property where the heat source (e.g., a hair dryer) can melt the fiber onto the braid and then the fiber cools immediately creating a tight wrap around the crochet. Also, further wrapping the hair around the crochet will hide the loop-hole which creates a seamless install.

A user can affix the lace closure to any portion of the head, as opposed to a wig, for example. The user can customize the style of the lace closure and the hair-braid, and cover the bald spots or hair thinning areas. Yet another advantage is that a user can connect the natural hair of a person to the lace by sewing it, which holds them firmly attached to each other.

While the present disclosure has been shown and described with reference to certain embodiments thereof, it will be understood by those skilled in the art that various changes in form and details may be made therein without departing from the spirit and scope of the present disclosure as defined by the appended claims and their equivalents. Therefore, the scope of the present disclosure should not be limited to the above-described embodiments but should be determined by not only the appended claims but also the equivalents thereof.

In the above-described embodiments, all operations may be selectively performed or part of the operations may be omitted. In each embodiment, the operations are not necessarily performed in accordance with the described order and may be rearranged. The embodiments disclosed in this specification and drawings are only examples to facilitate an understanding of the present disclosure, and the present disclosure is not limited thereto. That is, it should be apparent to those skilled in the art that various modifications can be made on the basis of the technological scope of the present disclosure.

Furthermore, the embodiments of the present disclosure have been described in the drawings and specification. Although specific terminologies are used here, the terminologies are only to describe the embodiments of the present disclosure. Therefore, the present disclosure is not restricted to the above-described embodiments and many variations are possible within the spirit and scope of the present disclosure. It should be apparent to those skilled in the art that various modifications can be made on the basis of the technological scope of the present disclosure in addition to the embodiments disclosed herein and the following claims. Furthermore, the embodiments may be combined to form additional embodiments.

What is claimed is:

1. A method for hair-braiding, comprising:

providing a lace base with synthetic hair, parting the synthetic hair of the lace base into a section of hairs, providing a crochet hair extension, where the crochet hair extension includes a loop at a proximal end and braided hair strands extending distally from the loop, pulling the loop of the crochet hair extension over a hook, attaching the section of hairs to the hook, pulling the hook with the attached sections of hairs through the loop of the crochet hair extension, wrapping the section of hairs around the crochet hair extension, tying a portion of the section of hairs around the crochet hair extension, and applying heat to the wrapped section of hairs to heat shrink the section of hairs.

2. The method of claim 1, further comprising attaching the lace base attached to natural hair of a person.

3. The method of claim 2, wherein the attaching of the lace base to the natural hair of the person is performed by sewing.

4. The method of claim 1, wherein the heat shrinking of the section of hairs increases a grip of the crochet hair extension by the section of hairs.

5. The method of claim 1, wherein the synthetic hair is made of vinyon fibers or polyvinyl chloride fibers.

6. The method of claim 1, wherein the applying heat to the wrapped section melts the synthetic hair onto the crochet hair extension.

7. The method of claim 6, the method further comprising: cooling the wrapped section to create a tight wraps around the crochet hair extension.

8. The method of claim 6, wherein the wrapping the section of hairs around the crochet hair extension includes wrapping the section of hair around the loop of the crochet hair extension to cover the loop and create a seamless install.

9. A method of attaching a hair extension, comprising:

making a lace base with synthetic hair, attaching the lace base to a head of a person, parting the synthetic hair from the lace base into sections of hairs, providing a crochet hair extension, where the crochet hair extension includes a loop at a proximal end and hair strands extending distally from the loop, pulling the loop of the crochet hair extension over a hook, attaching one of the sections of hairs to the hook, pulling the hook with the attached one of the section of hairs through the loop of the crochet hair extension, wrapping a first portion of the one of the section of hairs around the crochet hair extension, tying a second portion of the one of the sections of hairs around the crochet hair extension, and applying heat to the first portion of the one of the section of hairs to heat shrink the first portion of the one of the section of hairs.

10. The method of claim 9, wherein the lace base is attached to the person's scalp by gluing.

11. The method of claim 9, wherein the lace base is attached to a natural hair of the person.

12. The method of claim 11, wherein the attaching of the lace base to the natural hair of the person is performed by sewing.

* * * * *